US006247521B1

(12) United States Patent
Kawai et al.

(10) Patent No.: US 6,247,521 B1
(45) **Date of Patent: *Jun. 19, 2001**

(54) PRESSURE DIFFERENCE CONTROL METHOD FOR FILLING A CAVITY WITH MELT

(75) Inventors: Hiroshi Kawai, Toyota; Seiji Hirata; Yasutaka Furukawa, both of Hekinan, all of (JP)

(73) Assignees: Toyota Jidosha Kabushiki Kaisha, Toyota; Kabushiki Kaisha Isuzu Seisakusho, Nagoya, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/698,110

(22) Filed: Aug. 15, 1996

(51) Int. Cl.[7] ..... B22D 46/00
(52) U.S. Cl. ..... 164/457; 164/119; 164/63
(58) Field of Search ..... 164/457, 155.3, 164/63, 255, 119

(56) References Cited

U.S. PATENT DOCUMENTS

| | | | | |
|---|---|---|---|---|
| 3,961,662 | * | 6/1976 | Balevski et al. | 164/457 |
| 4,741,381 | * | 5/1988 | Nishida et al. | 164/457 |
| 5,178,009 | * | 1/1993 | Arekampadi et al. | 73/292 |
| 5,551,502 | * | 9/1996 | Marsubayashi et al. | 164/457 |
| 5,597,032 | * | 1/1997 | Merrien | 164/457 |

FOREIGN PATENT DOCUMENTS

| | | | | |
|---|---|---|---|---|
| 59-10461 | | 1/1984 | (JP) . | |
| 59-118258 | * | 7/1984 | (JP) | 164/155.3 |
| 60-188818 | | 9/1985 | (JP) . | |
| 62-248551 | | 10/1987 | (JP) . | |
| 1-60761 | | 4/1989 | (JP) . | |
| 2-169170 | * | 6/1990 | (JP) | 1264/155.3 |
| 3-458 | * | 1/1991 | (JP) | 164/457 |
| 5-228604 | | 9/1993 | (JP) . | |
| 7-136755 | | 5/1995 | (JP) . | |

* cited by examiner

*Primary Examiner*—Harold Pyon
*Assistant Examiner*—I.-H. Lin
(74) *Attorney, Agent, or Firm*—Oliff & Berridge, PLC

(57) ABSTRACT

A melt filling pressure difference control method controls a pressure difference used to supply melt from a holding furnace to a cavity of a casting machine by generating a pressure difference between an interior space of holding furnace and the cavity formed inside the mold. The method includes the steps of setting up a program pattern comprising time-varying characteristics of pressure difference target values, controlling the pressure difference so as to follow the program pattern that was set up, detecting whether the melt surface has risen to a predetermined level inside the cavity, compensating the program pattern based on the melt surface level when the melt surface has risen to a predetermined level inside cavity, and controlling the pressure difference between space inside the holding furnace and the cavity so as to follow the compensated program pattern.

54 Claims, 6 Drawing Sheets

PRESSURE DIFFERENCE CONTROL METHOD FOR FILLING A CAVITY WITH MELT

BACKGROUND OF THE INVENTION

1. Field of the Invention

The present invention relates to a casting technique. In particular, it relates to a technique for filling a cavity with melt (i.e. molten metal). A casting machine employing this invention is equipped with a holding furnace that stores the melt, a mold with a cavity formed in its interior, a melt duct that interconnects the holding furnace and the cavity, and a device that generates a pressure difference between the pressure inside the holding furnace and the pressure inside the cavity, and is characterized in that said cavity is filled by the melt inside said holding furnace by way of said melt duct due to this pressure difference.

2. Prior Art

Prior art that relates to this is disclosed in Japanese Laid-Open Patent Publication JP-A-59-10461, and FIG. 4 shows a schematic view of a casting machine that employs this method.

This low-pressure casting machine 1 is equipped with holding furnace 6 that stores the melt, and mold 3 positioned directly above this holding furnace 6 by fixing plate 2. Cavity 4 is formed in the interior of mold 3. A tubular melt duct 5 is connected to mouth piece 4*h* of said mold 3, and interconnects cavity 4 formed inside mold 3 with the interior of holding furnace 6. Here, said cavity 4 is released to atmospheric pressure via exhaust ducts (not illustrated), while on the other hand said holding furnace 6 is sealed and compressed air is supplied to the interior thereof by compressor 7. It is thus possible to generate a pressure difference between the pressure inside cavity 4 and the pressure inside holding furnace 6.

Said compressor 7 is made able to vary (increase) the pressure in said holding furnace 6 according to a prescribed pattern, and this variation of pressure causes the melt inside holding furnace 6 to be filled into cavity 4 through melt duct 5. Here, the difference in level between the surface of the melt filled in cavity 4 through said melt duct 5 and the surface of the melt inside holding furnace 6 is proportional to the pressure difference between the pressure inside the cavity and the pressure inside the holding furnace. It is thus possible to control the surface level of the melt filled into cavity 4 by controlling the pressure inside holding furnace 6. It is also possible to control the rate at which the melt rises by raising the pressure inside holding furnace 6 according to a prescribed pattern.

The pressure control method in this low-pressure casting machine 1 establishes a three-tier pressure pattern that is divided between the period during which the melt rises through melt duct 5 to the entrance of cavity 4, the period during which the melt is filled into cavity 4, and a feeder head pressurizing stage.

That is, in the stage during which the melt is supplied as far as the entrance of cavity 4, solenoid valves 8*a* and 8*b* of compressor 7 are opened and a large amount of compressed air flows into holding furnace 6 through pipelines 9*a* and 9*b*. Accordingly, the pressure inside holding furnace 6 rises quickly and the melt rises up at high speed inside melt duct 5 to arrive at the entrance of cavity 4. Next, when the pressure in said holding furnace reaches a first prescribed pressure, the melt surface is considered to have risen to the entrance of cavity 4 and solenoid valve 8*b* is closed.

Consequently, compressed air is only supplied to holding furnace 6 through pipeline 9*b*, and the rate of pressure increase inside holding furnace 6 is relaxed by the drop in the compressed air supply rate. As a result, the melt is slowly filled into cavity 4. Then, when the pressure inside holding furnace 6 reaches a second prescribed pressure, cavity 4 is deemed to have been filled with melt, and solenoid valve 8*c* is opened. Consequently, compressed air is supplied to holding furnace 6 through pipelines 9*b* and 9*c*, and the pressure rises quickly again so that the melt inside cavity 4 is subjected to feeder head pressurizing.

As mentioned above, in low-pressure casting machine 1, the melt surface is considered to have arrived at the entrance of cavity 4 when the pressure inside holding furnace 6 has reached a first prescribed pressure, whereupon the pattern of pressure increase is changed into a relaxed pattern. That is, the increase in pressure per unit time is reduced when it has reached the first prescribed pressure. Also, cavity 4 is considered to have filled up with melt when it has reached a second prescribed pressure, whereupon the pattern of pressure increase is changed into a steep pattern. That is, the increase in pressure per unit time is increased when it has reached the second prescribed pressure.

However, the occurrence of phenomena such as back pressure in cavity 4 and variation in the melt surface level in holding furnace 6 arising from a variation in the amount of melt stored in holding furnace 6 can result in the melt surface not actually reaching the prescribed positions when the pressure in holding furnace 6 has reached the first or second prescribed pressure. Conversely, it is also possible that the actual melt surface will rise above the prescribed positions.

In such situations, if operations are continued according to the pattern of pressure increase set initially, it will become impossible to change the pattern of pressure increase at the point where the melt surface has actually reached the entrance of cavity 4 and at the point where cavity 4 has actually been filled with the melt. Therefore, this can give rise to defects whereby, for example, air is mixed in with the melt by filling cavity 4 at high speed when it should be filled slowly, or conversely whereby the melt temperature drops due to the melt surface being brought up slowly inside melt duct 5 when it should be brought up at high speed. Also, if the feeder head pressure after filling is insufficient, problems such as pipes in the moldings can Occur.

SUMMARY OF THE INVENTION

The present invention addresses itself to the technical problem of actually measuring the melt surface inside the cavity and compensating a preset pattern of pressure increase inside the holding furnace based on the result of this measurement, thereby filling the cavity with melt at an appropriate speed and achieving a satisfactory feeder head pressure after filling with melt by applying a suitable pattern of pressure increase inside the holding furnace.

Note that in the above-mentioned example, the interior of the holding furnace is pressurized to generate a pressure difference between the interior of the cavity and said holding furnace. However, it is also possible to fill the cavity with melt by reducing the pressure inside the cavity instead. Alternatively, the cavity can be filled by reducing the pressure inside the cavity and increasing the pressure inside the holding furnace. In any case, the surface level of the melt filled into the cavity is controlled according to the pressure difference between the pressure in said cavity and the pressure in said holding furnace.

The present invention is used in a casting machine. A casting machine employing this invention is equipped with a holding furnace that stores the melt, a mold with a cavity formed in its interior, a melt duct that inter connects the holding furnace and the cavity, and a device that generates a pressure difference between the pressure inside the holding furnace and the pressure inside the cavitey, and is characterized in that said cavity is filled by the melt inside said holding furnace by way of said melt duct due to this pressure difference.

The method of this invention is a method for controling said pressure difference in order to fill said melt into said cavity, and includes the steps of setting up a pressure difference control program defining target values for the rate of pressure difference increase after corresponding times have elapsed; based on this pressure difference control program and the actuale lapsed time, adjusting the actual rate at which the pressure difference rises to the target value of the rate at which the pressure difference rises at that time; detecting the time at which the melt surface reaches a predetermined level inside said cavity; and correcting the elapsed times in said control program based on the time detected in this time detection step.

The pressure difference control program, for instance, has a target rate of pressure difference increase of 1 kg/cm$^2$•min until 3 minutes have elapsed after the filling operation is started, and the target rate of pressure difference increase after 3 minutes have elapsed and before 5 minutes have elapsed is defined as 0.5 kg/cm$^2$•min. In general, the target rate of pressure difference increase is controlled according to the elapsed time by the pressure difference control program. This pressure difference control program it set up according to the relationship whereby, under normal conditions, the melt is satisfactorily filled into the cavity. For example, in the example mentioned above, if the pressure is made to rise by 1 kg/cm$^2$ each minute for the first 3 minutes after the filling operation is started, then it is presumed that under normal conditions the melt will have reached the bottom level of the cavity after 3 minutes have elapsed, whereafter the rate of pressure increase per unit time is reduced to a rate of 0.5 kg/cm$^2$•min.

As mentioned above, this presumption may not hold true in actual operations. For example, after 3 minutes the melt may have already begun to fill the cavity before a pressure difference of 3 kg/cm$^2$ is reached, or conversely the melt may not yet have reached the bottom level of the cavity. In the present invention, the time at which the melt surface has risen to a predetermined level is detected. The time at which this is detected may be, for example, 2.5 minutes, which is ahead of schedule (Example 1), 3.0 minutes, which is on-schedule (Example 2), or 3.5 minutes, which is behind schedule (Example 3). Therefore, in this invention the lapsed times in the pressure difference control program are corrected according to the timing detected in this way. For example, in the case of Example 1 above, the elapsed time of 3 minutes in the pressure difference control program is corrected to 2.5 minutes. On the other hand, in the case of Example 3, the elapsed time of 3 minutes is corrected to 3.5 minutes. Note that the same results can be achieved by, in Example 1, correcting the actual elapsed time of 2.5 minutes to the value of 3 minutes in the control program and, in Example 3, correcting the actual elapsed time of 3.5 minutes to the value of 3 minutes in the control program, since this approach is mathematically identical.

One embodiment of the method of the invention includes the steps of: detecting a first timing at which the melt has risen to said bottom end of said cavity; reducing the rate of said pressure difference increase when this first timing is detected; detecting a second timing at which the melt has risen to said top end of said cavity; and increasing the state of said pressure difference increase when this second timing is detected.

With this method, the melt is made to rise quickly during the period when the surface of the melt rises up to the bottom of the cavity and slowly during the period when the surface of the melt is at a position inside the cavity, and the pressure difference is quickly increased after the cavity has been filled.

The invention can be understood in greater detail by reading the text of the following embodiments and claims with reference to the figures.

DESCRIPTION OF THE PREFERRED EMBODIMENTS

Figure 1:
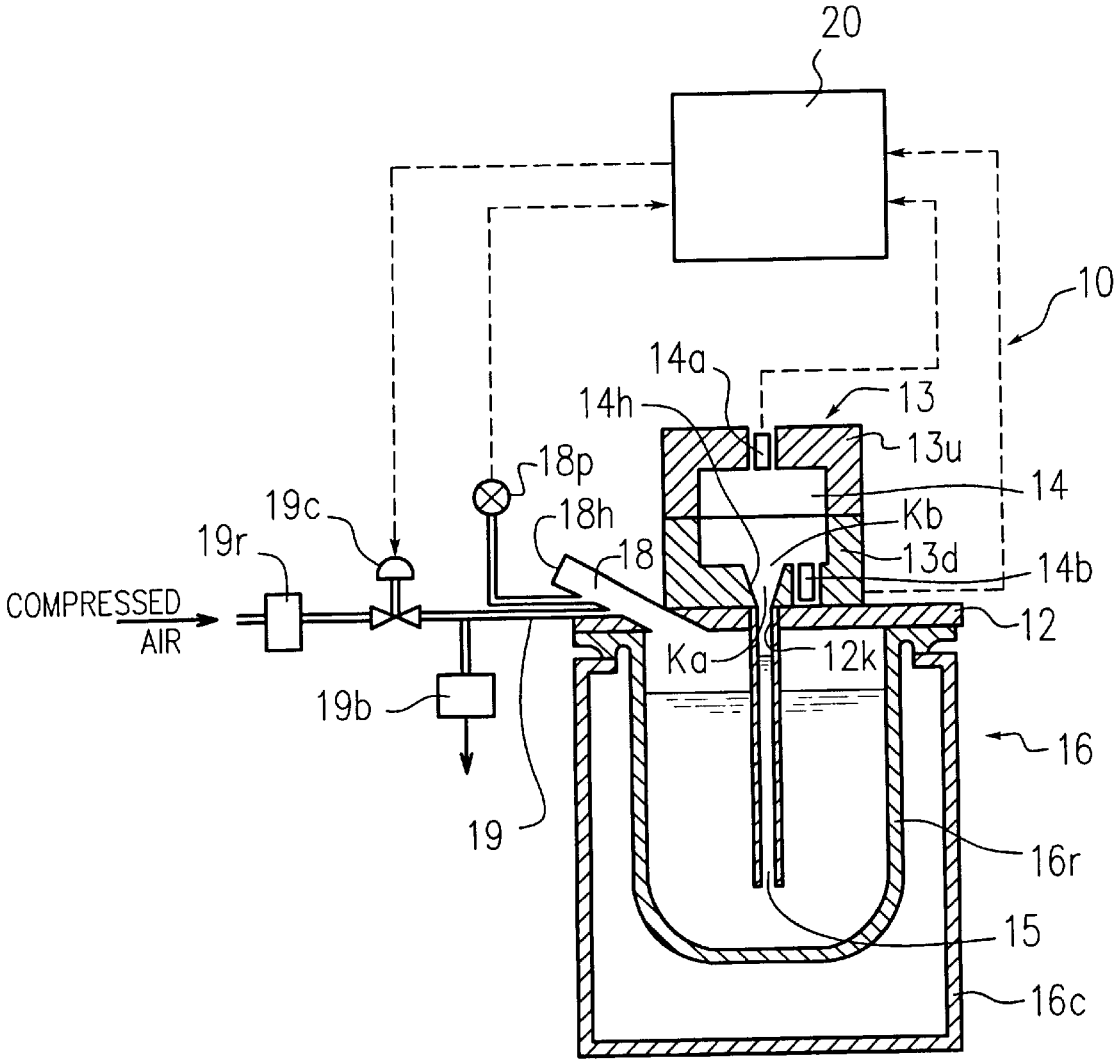
FIG. 1 is an overall cross-section of a low-pressure casting machine used to implement a melt-filling pressure-difference control method relating to an embodiment of the present invention.
Figure 2:
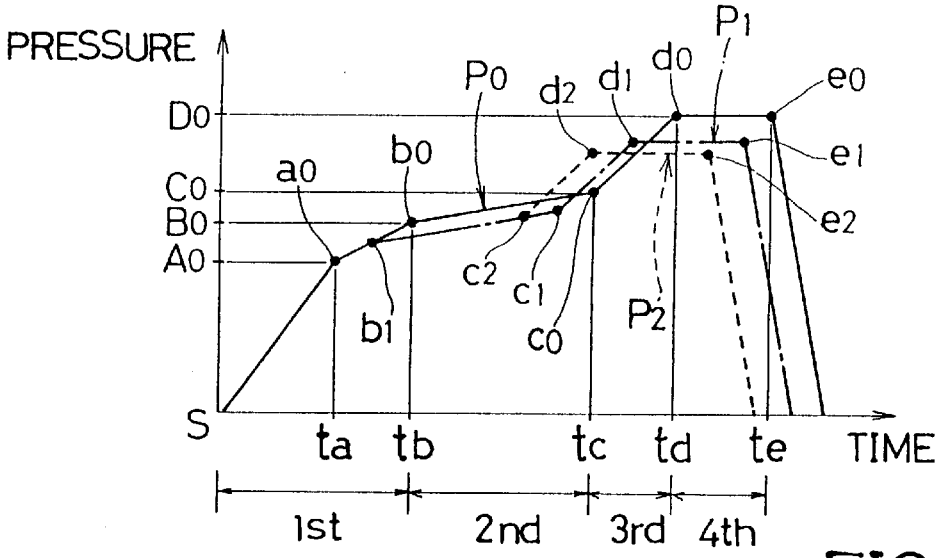
FIG. 2 shows an example of the pattern of a pressure difference control program along with that of a corrected pressure difference control program in a melt-filling pressure-difference control method relating to an embodiment of the present invention.
Figure 3:
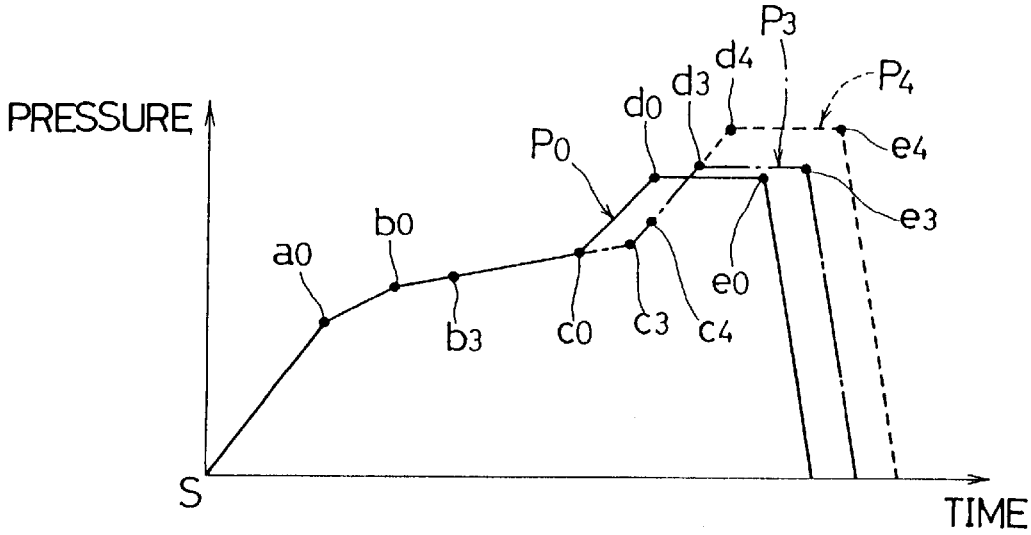
FIG. 3 shows another example of the pattern of a pressure difference control program along with that of a corrected pressure difference control program in a melt-filling pressure-difference control method relating to an embodiment of the present invention.
Figure 4:
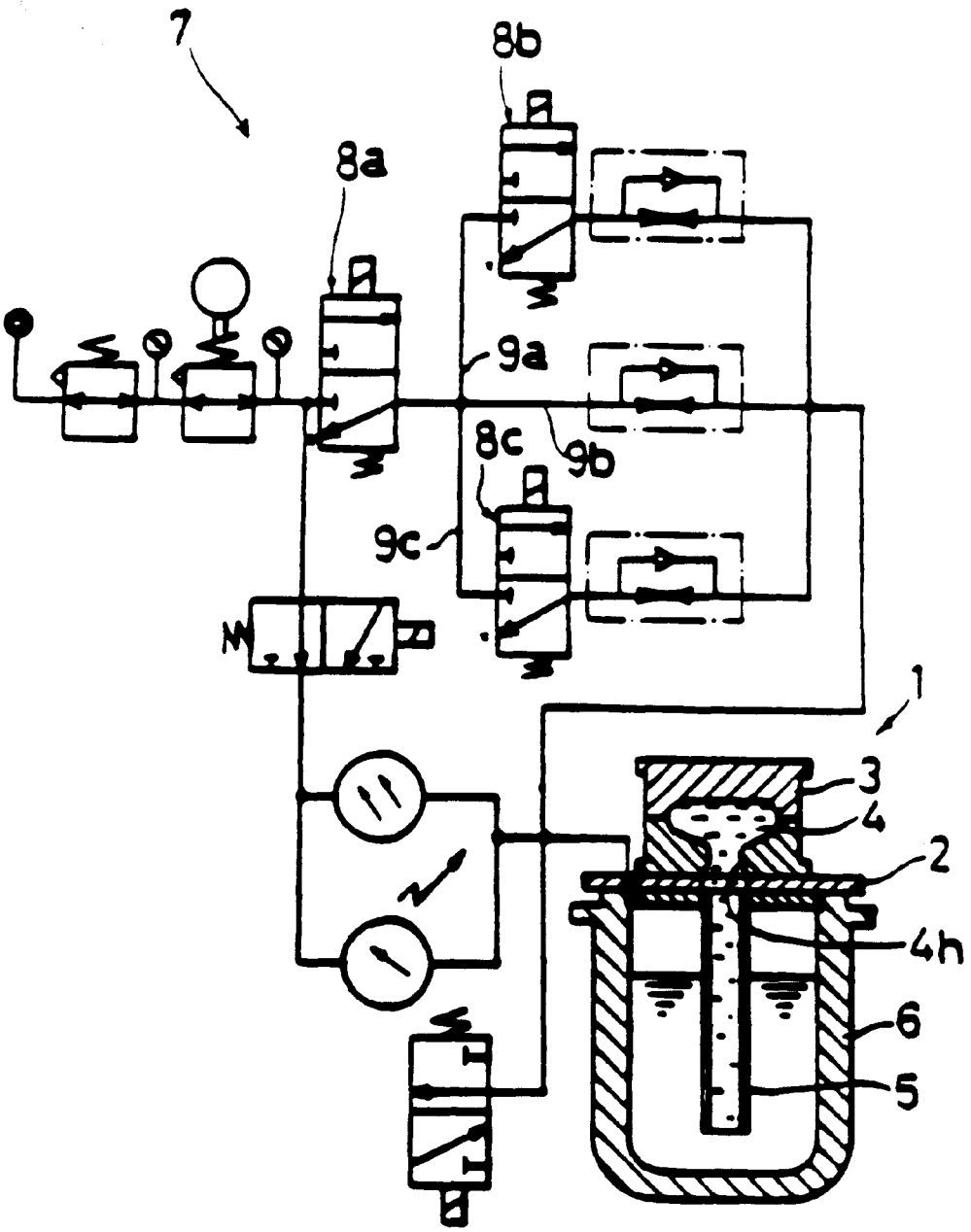
FIG. 4 PRIOR ART
FIG. 4 is an overall cross-section of a low-pressure casting machine used to implement a conventional melt-filling pressure-difference control method.

A pressure-difference control method for melt filling relating to an embodiment of the present invention is now described based on FIGS. 1 to 3. FIG. 1 is an overall cross-section of a low-pressure casting machine 10 used to implement a melt-filling pressure-difference control method relating to the present embodiment.

Said low-pressure casting machine 10 is provided with holding furnace 16 which stores a molten metal such as aluminum (referred to as the melt hereinafter), and mold 13 positioned directly above this holding furnace 16 by fixing plate 12, and a tubular stalk 15 (melt duct) is connected to mouth part 14*h* of said mold 13. Said stalk 15 passes through opening 12*k* formed in the center of said fixing plate 12, and is supported hanging down from fixing plate 12 with its lower end immersed in the melt stored in said holding furnace 16.

Said holding furnace 16 comprises crucible 16*r* which stores the melt, and casing 16*c* which houses this crucible

16*r* and keeps it hot by means of a heater (not illustrated), and the top opening of said crucible 16*r* is closed off by said fixing plate 12. Also, a melt inlet 18, through which melt is supplied into said crucible 16*r*, is provided at an inclined angle at the end of said fixing plate 12 (left of center in the figure), and a pressure sensor 18*p* for detecting the pressure inside crucible 16 is fitted at the position of this melt inlet 18. The pressure signal from said pressure sensor 18*p* is input to control device 20, which comprises a microprocessor. Note that said melt inlet 18 is closed off by cover 18*h* after supplying melt into crucible 16*r*, and thus said pressure sensor 18*p* is able to accurately measure the pressure inside holding furnace 16.

Also, a pressurizing pipeline 19 for pressurizing the interior of holding furnace 16 is connected to said melt inlet 18. Said pressurizing pipeline 19 is a pipeline for guiding compressed air from a compressor (not illustrated) to the inside of holding furnace 16, and is fitted along the way with reducing valve 19*r* and flow control valve 19*c* situated downstream thereof. Here, said flow control valve 19*c* is remotely operated by means of operating signals from said control device 20 to control the pressure inside holding furnace 16, as mentioned below. Also, an exhaust valve 19*b* for exhausting the air inside holding furnace 16 is attached downstream of said flow control valve 19*c*. Note that exhaust valve 19*b* is normally closed.

Said mold 13 comprises cope 13*u* and drag 13*d*, which form cavity 14 when fastened together. Cavity 14 is interconnected with the atmosphere via exhaust ducts (not illustrated). Also, an upper melt level detection sensor 14*a* is fitted to cope 13*u* of said mold 13 at the top level of cavity 14, and a lower melt level detection sensor 14*b* is fitted to drag 13*d* at the bottom level of cavity 14 (the top level Kb of mouth piece 14*h*). The melt level detection signals from upper melt level detection sensor 14*a* and lower melt level detection sensor 14*b* are input to said control device 20.

Said control device 20 stores a pressure control program that determines the time-varying characteristics of the target rate of pressure increase in order to vary the pressure inside holding furnace 16 with time. This program determines target values for the rate of pressure increase with respect to the elapsed time; an example of a pattern produced by this program is shown by the solid lines (pattern $P_0$) in FIGS. 2 and 3. Note that said pressure control program can be inputted to the control device 20 from an input device (not illustrated), and can be revised. The orifice size of flow control valve 19*c* is controlled so that the pressure inside holding furnace 16 follows pattern $P_0$ of said pressure control program, That is, the pressure control program defines a rate of pressure increase per unit time corresponding to each elapsed time.

In pattern $P_0$ shown in FIG. 2, point S is the time at which the pressurizing of holding furnace 16 begins, and point $a_0$ is the time at which the pressure inside holding furnace 16 reaches pressure $A_0$, at which it should be possible to bring the melt surface up to the entrance (bottom level) Ka of mouth part 14*h* of mold 13 (See FIG. 1). Also, point $b_0$ is the time at which said pressure reaches pressure $B_0$, at which it should be possible to bring the melt surface up to the bottom level Kb of cavity 14 inside mold 13. Furthermore, point $c_0$ is the time at which said pressure reaches pressure $C_0$, at which it should be possible to bring the melt surface up to the top level inside cavity 14, point $d_0$ is the time at which it reaches pressure $D_0$ on completion of feeder head pressurizing, and point $e_0$ is the time at which the pressure is dropped prior to opening the mold.

The pressure control program defines a rate of pressure increase for the slope of the straight line S–$a_0$ during elapsed time 0–$t_a$, a rate of pressure increase for the slope of the straight line $a_0$–$b_0$ during elapsed time $t_a$–$t_b$, a rate of pressure increase for the slope of the straight line $b_0$–$c_0$ during elapsed time $t_b$–$t_c$, and a rate of pressure increase for the slope of the straight line $c_0$–$d_0$ during elapsed time $t_c$–$t_d$, while the rate of pressure increase during elapsed time $t_d$–$t_e$ is set to zero, and the pressure at elapsed time $t_e$ is set to zero. In this specification, elapsed time $t_b$ is defined as the first elapsed time, $t_b$–$t_c$ is defined as the second elapsed time, $t_c$–$t_d$ is defined as the third elapsed time, and $t_d$–$t_e$ is defined as the fourth elapsed time.

In this basic pattern $P_0$, since the rate of pressure increase from point S to point $a_0$ is large, the melt surface quickly rises to the bottom level Ka of mouth part 14*h*. In this way, the drop in melt temperature due to stalk 15 is improved to some extent. Also, since the pressure increase from point ao to point bo is slightly smaller, the Tate at which the melt Surface rises between the bottom level Ka of mouth part 14*h* to the bottom level Kb of cavity 14 is slightly slower. Furthermore, since the rate of pressure increase is gentler from point $b_0$ to point $c_0$, the rate at which the melt surface rises between the bottom level Kb of cavity 14 to the top level of cavity 14 is even gentler. In this way, the mixing of air in with the melt filled into the cavity is prevented. The rate of pressure increase between points $c_0$ and $d_0$ is set large so that the pressure quickly rises, and feeder head pressure is quickly applied to the melt filled into said cavity 14. In this way, the occurrence of pipes and the like is diminished. That is, the rate of pressure increase is made large from the time ($t_c$) at which the melt surface rises up to the top level of the cavity until the third elapsed time has elapsed, the rate of pressure increase is made zero after the third elapsed time has elapsed, and the pressure is made zero after the fourth elapsed time has elapsed. Also, the rate of pressure increase is made smaller after time $t_b$ has elapsed from the start of the filling operation, and subsequently the rate of pressure increase is made larger again after the second elapsed time has elapsed (time $t_c$).

First corrected pattern $P_1$ shown by the dashed line in FIG. 2 is the pattern used instead of basic pattern $P_0$ to control the pressure in holding furnace 16 when lower melt surface detection sensor 14*b* detects that the actual melt surface has risen to the bottom level Kb of the cavity ahead of schedule. That is, in basic pattern $P_0$, the melt surface should rise up to the height of said bottom level Kb at time bo. However, when lower melt surface detection sensor 14*b* has judged that the actual melt surface has risen to the height of bottom level Kb of the cavity in a shorter period (while pressure control is being performed between points $a_0$ and $b_0$), the control switches from basic pattern $P_0$ to first corrected pattern $P_1$ at this time, and the pressure inside holding furnace 16 is thereafter controlled based on this first corrected pattern $P_1$. Here, point $b_1$ of first corrected pattern $P_1$ is the time at which lower melt level detection sensor 14*b* detects that the actual melt surface has risen to the height of bottom level Kb of the cavity. Also, the slope from point $b_1$ to point cl is set equal to the slope from point bo to point $c_0$ in said basic pattern $P_0$, and the slope from point $c_1$ to point $d_1$ in first corrected pattern $P_1$ is set equal to the slope from point $c_0$ to point $d_0$ in said basic pattern $P_0$. That is, if point $b_1$ is superimposed on point $b_o$, pattern $P_1$ will map exactly to pattern $P_0$. This pattern correction is achieved by correcting the elapsed time in the pressure control program by the difference in elapsed time between point $b_0$ and point $b_0$.

Also, second corrected pattern $P_2$ shown by the dotted line in FIG. 2 is the pattern used instead of basic pattern $P_0$ to control the pressure in holding furnace 16 when upper melt surface detection sensor 14*a* detects that the actual melt surface has risen to the top level of the cavity ahead of schedule. That is, in first corrected pattern $P_1$, the melt surface should rise up to the height of the top of cavity 14 at time $c_1$. However, when upper melt surface detection sensor 14*a* has judged that the actual melt surface has risen to the height of the top of cavity 14 in a shorter period (while pressure control is being performed between points $b_1$ and $c_1$), the control switches from first corrected pattern $P_1$ to second corrected pattern $P_2$ at this time, and the pressure inside holding furnace 16 is thereafter controlled based on this second corrected pattern $P_2$. Here, point $c_2$ of second corrected pattern $P_2$ is the time at which upper melt level detection sensor 14*a* detects that the actual melt surface has risen to the height of the top of cavity 14. Also, the slope from point $c_2$ to point $d_2$ is set equal to the slope from point $c_1$ to point $d_1$ in the first corrected pattern $P_1$. If points $c_2$, $c_1$ and $c_0$ are all superimposed, patterns $P_0$, $P_1$ and $P_2$ will all map exactly to each other. The above pattern correction process is implemented by correcting the elapsed time in the pressure control program by the difference in elapsed time between points $c_1$ and $c_2$.

Third corrected pattern $P_3$ shown by the dashed line in FIG. 3 is the pattern used instead of basic pattern $P_0$ to control the pressure in holding furnace 16 when lower melt surface detection sensor 14*b* detects that the actual melt surface has risen to the bottom level Kb of the cavity behind schedule. That is, in basic pattern $P_0$, the melt surface should rise up to the height of said bottom level Kb at time $b_0$ as mentioned above. However, when the actual melt surface rises slowly and lower melt surface detection sensor 14*b* judges that the melt surface has risen to the height of bottom level Kb of the cavity while pressure control is being performed between points $b_0$ and $c_0$, the $c_0$ ntrol switches from basic pattern $P_0$ to third Corrected pattern $P_3$ at this time, and the pressure inside holding furnace 16 is thereafter controlled based on this third corrected pattern $P_3$. Here, point $b_3$ of third corrected pattern $P_3$ is the time at which lower melt level detection Sensor 14*b* detects that the melt surface has risen to the height of bottom level Kb of the cavity, and the line from point $b_3$ to point $c_3$ is made by duplicating the line from point $b_0$ to point $c_0$ in basic pattern $P_0$. Also, the slope from point $c_3$ to point $d_3$ is set equal to the slope from point $c_0$ to point $d_0$ in basic pattern $P_0$. As before, if point $b_3$ is superimposed on point $b_0$, pattern $P_3$. Will map exactly to pattern $P_0$. This process is also performed by Correcting the elapsed time in the pressure control program. Note that in FIG. 3, the rate of pressure increase is reduced at point bo. That is, when first elapsed time ($t_b$) has elapsed from the start of the filling operation before the melt surface reaches bottom level Kb of the cavity, the rate of pressure increase is reduced even if the melt surface has not reached bottom level Kb of the cavity. Note that in this specification, the time at which the melt surface reaches level Kb is defined as the first timing.

Fourth corrected pattern $P_4$ shown by the dotted line in FIG. 3 is the pattern used instead of third corrected pattern $P_3$ to control the pressure in holding furnace 16 when upper melt surface detection sensor 14*a* detects that the actual melt surface has risen to the top level of cavity 14 behind schedule. That is, in third corrected pattern $P_3$, the melt surface should rise up to the height of the top of cavity 14 at time $C_3$. However, when the actual melt surface rises slowly and upper melt surface detection sensor 14*a* judges that the melt surface has risen to the height of the top level of cavity 14 while pressure control is being performed between points $C_3$ and $d_3$, the control switches from third corrected pattern $P_3$ to fourth corrected pattern $P_4$ at this time. The pressure inside holding furnace 16 is thereafter controlled based on this fourth corrected pattern $P_4$. Here, point $C_4$ of fourth corrected pattern $P_4$ is the time at which upper melt level detection sensor 14*a* detects that the melt surface has risen to the height of the top of cavity 14, and the line from point $C_4$ to point $d_4$ is made by duplicating the line from point $b_3$ to point $C_3$ in third corrected pattern $P_3$. As above, if points $C_4$, $C_3$ and co are superimposed, patterns $P_0$, $P_3$ and $P_4$ will map to each other. As the relationship between point $C_3$ and point $C_4$ clearly shows, when second elapsed time (from $t_b$ to $t_c$) has elapsed from the first timing ($b_3$) before the melt surface reaches the top level of the cavity, the rate of pressure increase is reduced even if the melt surface has not reached the top level of the cavity. Note that in this specification, the time at which the melt surface reaches the top level of the cavity is defined as the second timing.

Here, said basic pattern $P_0$ is switched to first corrected pattern $P_1$ or third corrected pattern $P_3$ based on the program stored in control device 20 by correcting the values of the elapsed times in the control program based on the time at which the melt surface detection signal is input from lower melt surface detection sensor 14*b*. In the same way, first corrected pattern $P_1$ is switched to second corrected pattern $P_2$ and third corrected pattern $P_3$ is switched to fourth corrected pattern $P_4$ based on the program stored in control device 20 by correcting the values of the elapsed times in the control program based on the time at which the melt surface detection signal is input from upper melt surface detection sensor 14*a*.

The melt filling pressure difference control method of the casting machine relating to the present invention will now be described.

As shown in FIG. 1, mold 13 is fastened together and set on fixing plate 12, whereupon control of the pressure inside holding furnace 16 is started based on basic pattern $P_0$ shown in FIG. 2 and FIG. 3. As a result, the melt inside crucible 16*r* rises at high speed through stalk 15 to the height of bottom level Ka of mouth piece 14*h*, and is supplied into mouth piece 14*h* relatively slowly from this bottom level Ka. Here, when the melt surface is judged to have risen to the height of bottom level Kb of the cavity by lower melt level detection sensor 14*b* while pressure control is being performed between point $a_0$ and point $b_0$ of basic pattern $P_0$, the control switches from basic pattern $P_0$ to first corrected pattern $P_1$ at this time, as shown in FIG. 2. The pressure inside holding furnace 16 then continues to be controlled from point $b_1$ based on this first corrected pattern $P_1$, and the melt is slowly supplied into cavity 14. Furthermore, when the melt surface is judged to have risen to the height of the top of cavity 14 by upper melt level detection sensor 14*a* while pressure control is being performed between point $b_1$ and point $c_1$ of first corrected pattern $P_1$, the control switches from first corrected pattern $P_1$ to second corrected pattern $P_2$ at this time. The pressure inside holding furnace 16 then continues to be controlled from point $c_2$ based on this second corrected pattern $P_2$, and feeder head pressure is applied to the melt filled into said cavity 14. In this way, when the pressure control proceeds to point $e_2$ of second corrected pattern $P_2$, exhaust valve 19*b* provided on pressurizing pipeline 19 is opened to release the pressure in holding furnace 16, and mold 13 is opened.

Also, when the melt surface is judged to have risen to the height of bottom level Kb of the cavity by lower melt level detection sensor 14*b* while pressure control is being performed between point $b_0$ and point $c_0$ of basic pattern $P_0$, the control switches from basic pattern $P_0$ to third corrected pattern $P_3$ at this time, as shown in FIG. 3. The pressure inside holding furnace 16 then continues to be controlled from point $b_3$ based on this third corrected pattern $P_3$, and the melt is slowly supplied into cavity 14. Furthermore, when the melt surface is judged to have risen to the height of the top of cavity 14 by upper melt level detection sensor 14*a* while pressure control is being performed between point $c_3$ and point $d_3$ of third corrected pattern $P_3$, the control switches from third corrected pattern $P_3$ to fourth corrected pattern $P_4$ at this time. The pressure inside holding furnace 16 then continues to be controlled from point $C_4$ based on this fourth corrected pattern $P_4$, and feeder head pressure is applied to the melt filled into said cavity 14. In this way, when the pressure control proceeds to point $e_4$ of fourth corrected pattern $P_4$, exhaust valve 19*b* provided on pressurizing pipeline 19 is opened to release the pressure in holding furnace 16, and mold 13 is opened.

In this way, the present embodiment is able to detect the actual melt surface at two places—at the bottom Kb of cavity 14 and at the top of cavity 14—and corrects the elapsed times of the initially set pressure pattern based on the times at which the melt level reaches these levels. Thus, the pressure is controlled based on a suitable pressure variation pattern that is matched to the actual circumstances, so that it becomes possible not only to fill the melt into the cavity at a suitable rate, but also to achieve a satisfactory feeder head pressure after filling with melt. Thus there is no incorporation of air into the melt filled inside cavity 14, and it also becomes unlikely that defects such as pipes will occur due to insufficient feeder head pressure. As a result, it is possible to reduce defects such as pressure leaks in pressure-resistant components.

Note that although the present embodiment has described a melt filling control method for a low-pressure casting machine 10, it can—needless to say—also be applied to a low-pressure casting machine wherein the melt is filled into a mold by reducing the pressure inside the cavity.

The melt surface detector devices preferably used in this method are described in the following.

Hitherto, the method conventionally used to detect the melt surface in the cavity of a mold has involved measuring the temperature by means of a thermocouple fitted to the wall forming the cavity of the mold, and inferring the time at which the surface of the melt injected into the mold reaches the level at which this thermocouple exists from the gradient of temperature increase.

However, with the above-mentioned conventional method, a certain time delay arises between the melt surface reaching a certain level and the temperature of the thermocouple at that level starting to rise. Therefore, there have been problems in that it is difficult to detect the melt surface level accurately, and it is thus impossible to accurately control the filling rate of the melt based on the melt surface level.

Also, since a thermocouple is a temperature measuring instrument wherein two kinds of metal are joined together and which is used to measure temperature by means of the characteristics of variation of the thermoelectric power arising from the temperature of the junction, it can often become unable to make measurements due to, for example, open circuits that occur when the junction is subjected to severe thermal conditions. It is therefore absolutely essential to perform regular maintenance.

The melt surface detection device described in the following is able to bring a sensor directly into contact with the melt and can thus not only accurately measure the melt surface level without having to consider time delays and the like, but it is also possible to set the strength of the sensor that is brought into contact with the melt to the same level as the strength of the mold or higher, so that the durability and reliability of the sensor are improved and it requires less effort to maintain.

Figure 5:
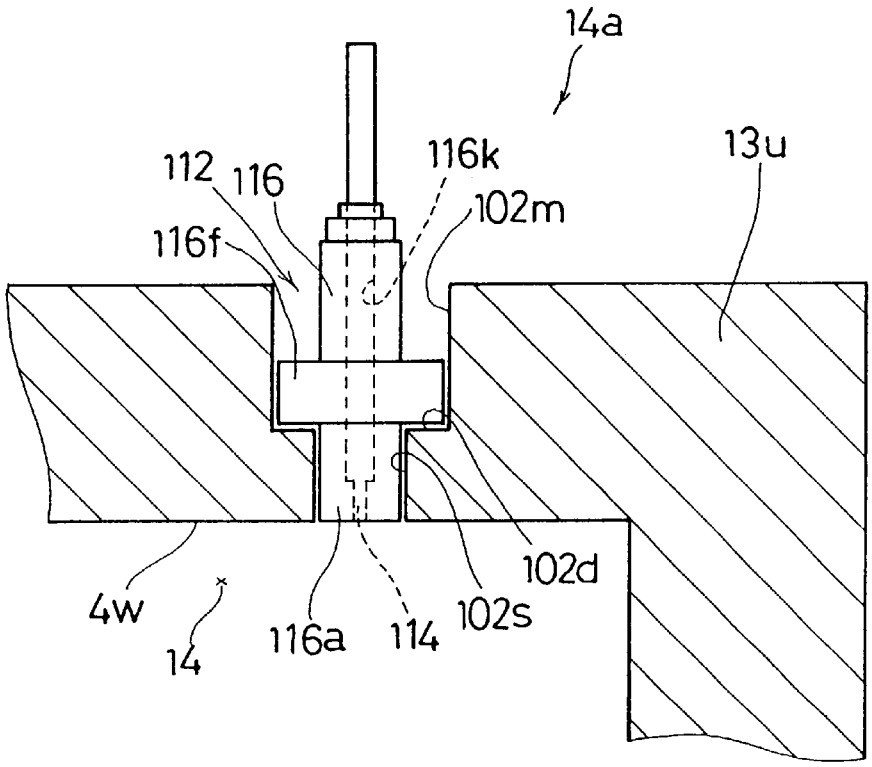
FIG. 5 is a detailed cross-section of the installation of a melt surface detection sensor used in the present invention.
Figure 6:
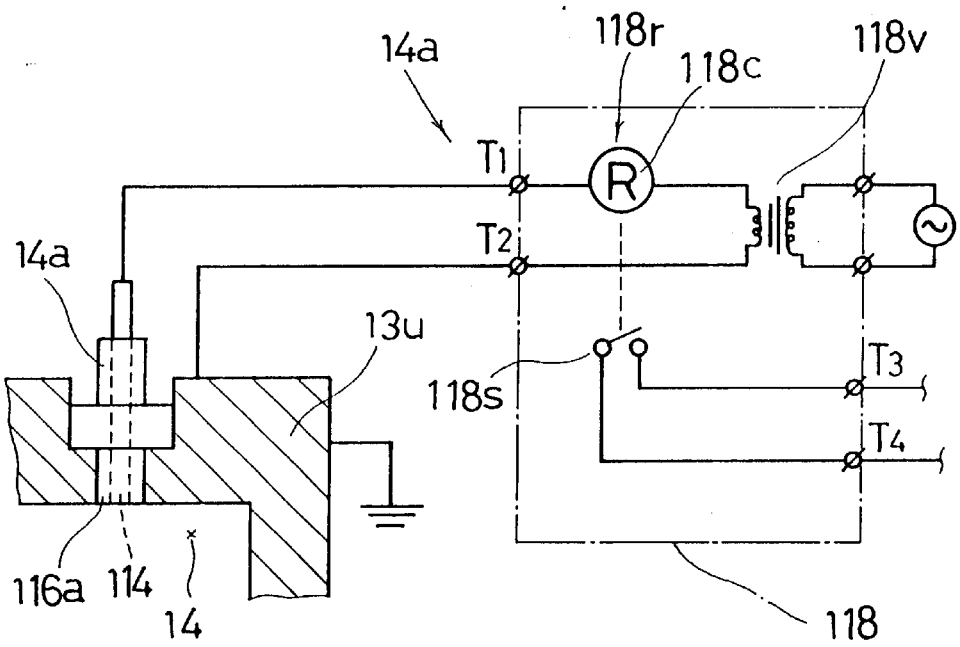
FIG. 6 is a circuit diagram of a melt surface detector device used in the present invention.
Figure 7:
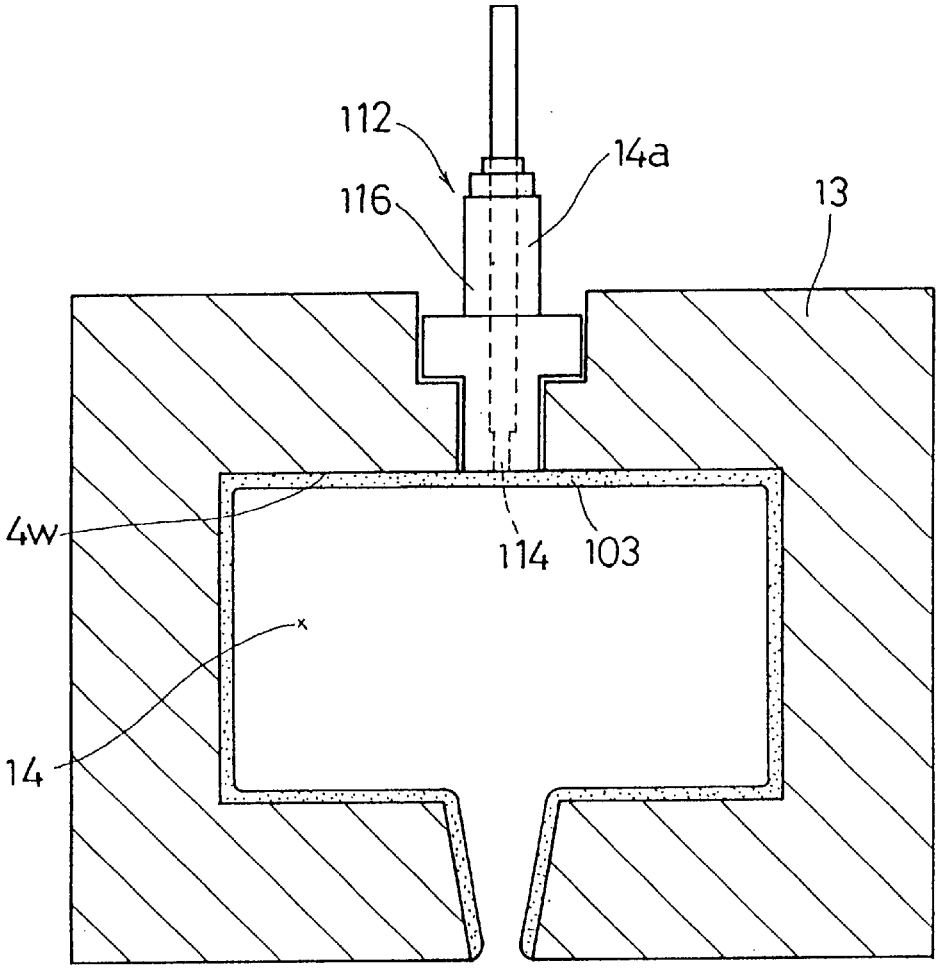
FIG. 7 is a cross-section showing the overall mold of a casting device.

In the following, a melt surface detection device relating to a first embodiment of the present invention is described based on FIGS. 5 through 7. Here, FIG. 5 is a detailed installation diagram of detection sensor 112 of melt surface detection sensor 14*a*, and FIG. 6 is a circuit diagram of melt surface detection sensor 14*a*. Also, FIG. 7 is a cross-section showing the entire mold 13.

Said detection sensor 112 is an upper sensor for detecting whether or not melt is filled into cavity 14, and as shown in FIG. 5 it consists of an electrically conductive electrode 114 fabricated from Fe—Ni steel and a ceramic insulating member 116 that insulates this electrode 114 from mold 13.

Said insulating member 116 is provided with flange part 116*f* formed into a cylindrical shape at a position in its center, and through-hole 116*k* along its central axis which houses said electrode 114. Here, said insulating member 116 is a ceramic chiefly consisting of $Al_2O_3$, and is joined to said electrode 114 by silver solder after being metallized. Also, when said insulating member 116 and electrode 114 are joined together, the lower end surface of this insulating member 116 and the lower end surface of electrode 114 are positioned in the same plane.

Large-diameter through-hole 102*m* and small-diameter through-hole 102*s* are formed coaxially at the top of said mold 13, and a ring-shaped step 102*d* is formed at the connecting part between through-holes 102*m* and 102*s*. Next, the end part 116*a* and flange part 116*f* of detection sensor 112 are respectively housed in said small-diameter throughhole 102*s* and large diameter through-hole 102*m*. Here, the length of said small-diameter through-hole 102*s* is set equal to the length of end part 116*a* of detection sensor 112, so that the lower end surface of this detection sensor 112 is flush with wall surface 4*w* of cavity 14 when said detection sensor 112 is set in mold 13. That is, the end surface of said detection sensor 112 constitutes a part of the wall surface 4*w* of cavity 14, and through the use of the above materials, its strength is at least of the same level as that of mold 13.

Electrode 114 of said detection sensor 112 is electrically connected to terminal $T_1$ of signal output unit 118, as shown in FIG. 6. Also, mold 13 is electrically connected both to earth and to terminal $T_2$ of signal output unit 118.

Said signal output unit 118 is a circuit for outputting a signal that shows whether or not electrode 114 of detection sensor 112 is electrically connected to mold 13 by the melt, and consists of a constant-voltage source 118*v* and a relay 118*r*. Constant-voltage source 118*v* and the coil 118*c* of said relay 118*r* are connected in series between terminal $T_1$ and terminal $T_2$. That is, electrode 114 of detection sensor 112, terminal $T_1$, coil 118*c*, constant voltage source 118*v*, terminal $T_2$ and mold 13 are all thereby connected in series, so that a fixed current flows in said coil 118*c* when said electrode 114 and mold 13 are electrically connected by the melt. When a current flows in said coil 118*c*, the contact point 118*s* of relay 118*r* is closed, and this signal is output to the control device (not illustrated) via terminals $T_3$ and $T_4$.

Next, the operation of melt surface detection sensor 14*a* relating to the present embodiment will be described.

While the melt surface has not yet reached the position of detection sensor 112 in cavity 14, the electrode 114 of this detection sensor 112 is insulated from mold 13 by insulating member 116, so that no current flows through coil 118*c* of relay 118*r* shows in FIG. 6. Therefore, the contact point 118*s* of relay 118*r* is left open. However, when the melt surface arrives at the position of detection sensor 112, said electrode 114 and mold 13 are electrically connected by the melt, and a fixed current flows through said coil 118*c*. As a result, relay 118*r* is operated and contact point 118*s* is closed, and this signal is output to said control device 20 via terminals $T_3$ and $T_4$.

In this way, with a melt surface detection device 14*a* relating to the present embodiment, since detection sensor 112 constitutes a part of wall surface 4*w* of cavity 14, the melt comes into direct contact with this detection sensor 112 and thus there are no time delays or such problems associated with the detection. Also, since electrode 114 of said detection sensor 112 is made of a material having a strength of the same or higher level than the strength of mold 13, and since insulating member 116 is made of ceramic, it has high durability and reliability, and it requires less effort to maintain.

Also, in the present embodiment, detection sensor 112 is fitted at the top of mold 13 (at the uppermost part of cavity 14) and is used to detect whether or not cavity 14 has been filled with melt; however, it is not limited to such a use, and can—needless to say—be used by fitting it at a prescribed level in said cavity 14 and detecting whether or nor the melt surface has reached this position.

Figure 8:
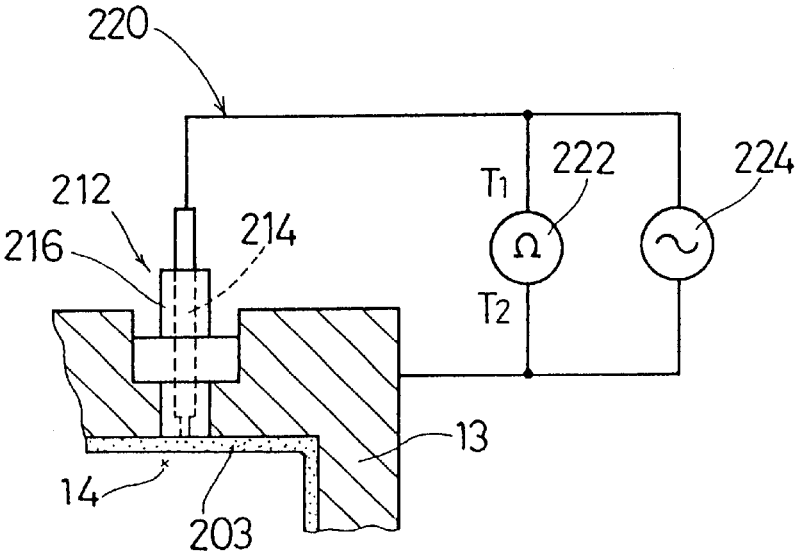
FIG. 8 is another example of the Circuit diagram of a melt surface detector device used in the present invention.
Figure 9:
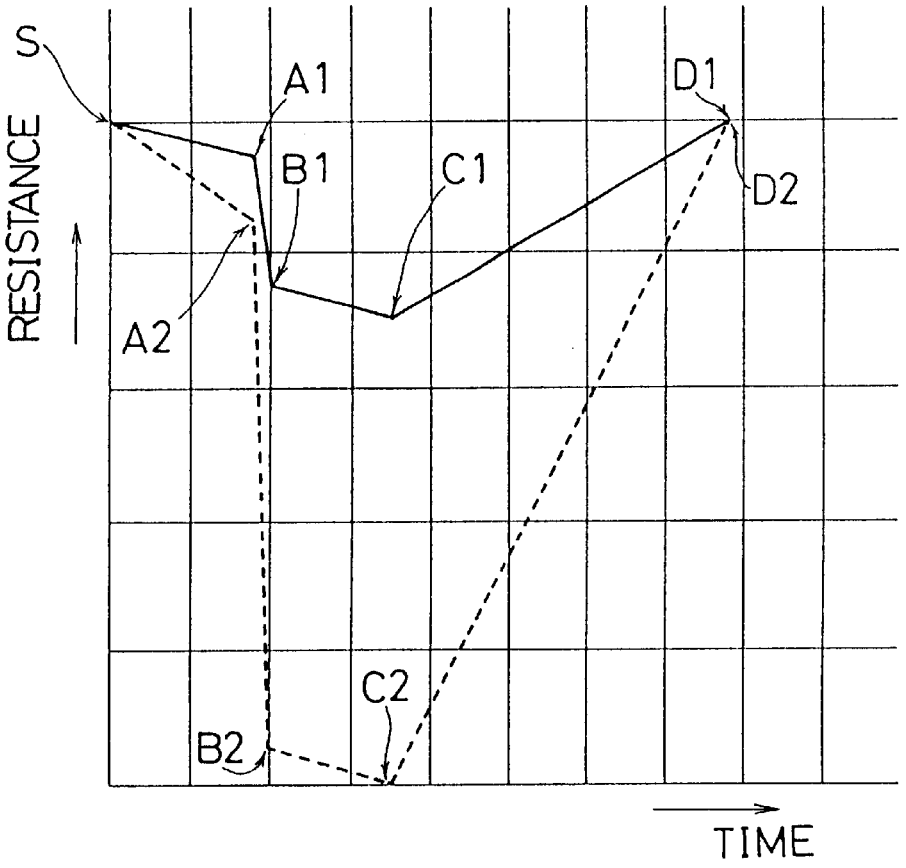
FIG. 9 is a graph showing the change in electrical resistance between the electrode and the mold in the interval between the start and finish of casting.

Next, melt surface detection device 220 relating to a second embodiment is described based on FIGS. 8 and 9.

Melt surface detection device 220 relating to the present embodiment constitutes an improvement on the electrical Circuit of signal detection unit 118 in melt detection device 14*a* relating to the first embodiment, and has a configuration wherein it is possible to measure the electrical resistance between mold 13 and electrode 214 of detection sensor 212. Note that the following description is simplified by using the same numbers to signify members that are identical to those used in melt surface detection device 14*a* of the first embodiment.

As shown in FIG. 8, in melt surface detection device 220 relating to the present embodiment, electrode 214 of detection sensor 212 is connected to first measurement terminal $T_1$, of a resistance meter 222, while mold 13 is connected to second measurement terminal $T_2$ of resistance meter 222. Also, a constant-voltage source 224 is connected to first measurement terminal $T_1$, and second measurement terminal $T_2$ of said resistance meter 222. With this circuit configuration, it is possible to continuously measure the electrical resistance between mold 13 and electrode 214 of said detection sensor 212. Also, said resistance meter 222 is able to output a signal to the control device (not illustrated) when the detected value is below a previously set value (set value).

FIG. 9 is a graph showing the variation in electrical resistance between mold 13 and electrode 214 between the start (point S) and finish (point D1, D2) of casting. Here, the solid line in the figure shows the variation in resistance when casting is performed with the wall surface 4*w* of cavity 14 coated with mold paint 203 that is an insulating substance, and the dotted line in the figure shows the variation in resistance when casting is performed without the wall surface 4*w* of cavity 14 being coated with mold paint 203. As shown in FIG. 1, when mold 13 is positioned directly above holding furnace 16, the inside of holding furnace 16 is pressurized by a compressor (not illustrated), and the melt is pushed up inside cavity 14 via stalk 15. The present embodiment is described for the case where casting is performed after coating with mold paint 203.

Point S in FIG. 9 shows the time at which pressurizing of the interior of holding furnace 16 is started. At the time the pressurizing is started, mold 13 and electrode 214 of detection sensor 212 are electrically insulated by insulating member 216, and as shown in FIG. 8, since the lower end surface of detection sensor 212 is coated with mold paint. 203 which is an insulating substance, the electrical resistance between said electrode 214 and mold 13—i.e., the value of the electrical resistance measured by resistance meter 222—is at its maximum. However, as melt is supplied into cavity 14 and the melt surface rises, the electrical resistance of insulator 216, mold paint 203 and so on gradually decreases due to the heat radiated from the melt, and as shown in FIG. 9, the resistance value of resistance meter 222 gradually decreases. Next, when the melt surface arrives near the top of cavity 14 and the melt starts to come into contact with detection sensor 212 via mold paint 203 (point A1), the resistance value of resistance meter 222 begins to drop sharply. Then, when cavity 14 is filled with melt (point B1), the resistance value of resistance meter 222 becomes equal to the resistance value of mold paint 203 situated between mold 13 and electrode 214 of detection sensor 212. The resistance value attributable to the melt is extremely small.

Accordingly, if the resistance value (B1) at point B1 is stored beforehand as a set value, it can be determined that the melt has reached the position of detection sensor 212 at the time when the measured value of resistance meter 222 becomes equal to this resistance value (B1), and it is possible to output a signal to said control device at this time. Note that point C1 in the figure is the time at which the melt inside cavity 14 begins to solidify, and point D1 is the time at which the resulting product is released from the mold.

On the other hand, when casting is performed with mold paint 203 removed from wall surface 4*w* of cavity 14 (shown by the dotted line in the figure), the measured value of resistance meter 222 is decreased by an amount corresponding to the resistance value of mold paint 203 compared with the case where it is coated with mold paint 203.

Here, the method mentioned above in melt surface detection device 14*a* relating to the first embodiment is employed, whereby relay 118*r* detects the state of electrical connection between mold 13 and electrode 114 of detection sensor 112. However, when wall surface 4*w* of cavity 14 is coated with mold paint 103, the current flowing through coil 118*c* will be insufficient to drive relay 118*r* due to the resistance of this mold paint 103, since mold paint 103—which is an insulating substance—is positioned between mold 13 and electrode 114 of detection sensor 112 even when the melt surface reaches the position of detection sensor 112. As a result, there is a limitation in that the melt surface detection device 14*a* relating to the first embodiment must be used in a state where no mold paint is applied to wall surface 4*w* of cavity 14.

However, since melt surface detection device 220 relating to the second embodiment employs a scheme whereby the resistance value is measured between mold 13 and electrode 214 of detection sensor 212, it is able to judge whether or not the melt surface has reached the position of detection sensor 212 from the variation in resistance, even when coated with mold paint 203 as mentioned above.

Also, even when mold 13 is used without coating it with mold paint, it is not essential to remove residual mold paint from the end surface of detection sensor 212 left over from previous usage, and there is no need to polish detection sensor 212. Accordingly, electrode 214 of said detection sensor 212 suffers hardly any erosion, and the sensor lifetime is improved.

What is claimed is:

1. A method of manufacturing a cast product using a casting machine, said casting machine including: a holding furnace that stores melt; a mold with a cavity formed in its interior; a melt duct that interconnects the holding furnace and the cavity; and a device that generates a pressure difference between the pressure inside the holding furnace and the pressure inside the cavity; and wherein said cavity is filled by the melt stored in said holding furnace via said melt duct due to the pressure difference, the method comprising the steps of:

providing a pressure difference control program defining a pattern of pressure difference increase rate target values, each pressure difference increase rate target value being associated with a target time period;

applying a first selected pressure difference increase rate target value to the melt stored in the holding furnace for a first target time period;

detecting an actual time period in which the melt moves from a first predetermined level inside the casting machine to a second predetermined level inside the casting machine as a result of applying the first selected pressure difference increase rate target value to the melt; and replacing the first target time period stored in the control program with the actual time period detected in the detecting step.

2. The method of claim 1, wherein the casting machine includes an electrode that is insulated from said mold and exposed to said cavity; and a device for detecting the electrical resistance between the electrode and the cavity;

wherein the detecting step comprises detecting the timing at which the electrical resistance changes to a set value.

3. The method of claim 2, wherein a strength of said electrode is at least of the same level as a strength of said mold.

4. The method of claim 2 wherein said electrode is surrounded by a ceramic insulating member.

5. The method as in claim 1, further comprising correcting the target time periods of the pattern based on the difference between the first target time period and the actual time period detected in the detecting step so as to correct the pattern prior to the cavity being filled by the melt.

6. A method of manufacturing a cast product using a casting machine, said casting machine including: a holding furnace that stores melt; a mold with a cavity formed in its interior extending vertically from a top end to a bottom end; a melt duct that interconnects the holding furnace and said bottom end of the cavity; and a device that generates a pressure difference between the pressure inside the holding furnace and the pressure inside the cavity; and wherein said cavity is filled by the melt stored in said holding furnace via said melt duct due to the pressure difference, the method including the steps of:

forcing the melt from the holding furnace and through said melt duct by applying a first rate of pressure difference increase to the melt stored in the holding furnace;

detecting when the melt has reached the bottom end of said cavity;

applying a second rate of pressure difference increase to the melt stored in the holding furnace when the melt has reached the bottom end of said cavity, wherein the second rate of pressure difference increase is less than the first rate of pressure difference increase;

detecting when the melt has reached the top end of said cavity; and applying a third rate of said pressure difference increase when the melt has reached the top end of said cavity, wherein the third rate of said pressure difference increase is greater than the second rate of pressure difference increase.

7. The method of claim 6, further comprising the step of applying the second rate of pressure difference increase when a set first time period after applying the first rate of pressure difference increase has elapsed, if the melt has not yet reached the bottom end of the cavity.

8. The method of claim 6, further comprising the step of applying the third rate of said pressure difference increase when a set second time period has elapsed after detecting that the melt has reached the bottom end of said cavity, if the melt has not yet reached the top end of the cavity.

9. The method of claim 6, wherein said cavity is opened to the atmosphere, and said pressure difference is generated by applying pressure to the holding furnace, which is sealed.

10. The method of claim 6, wherein said pressure difference is generated by reducing the pressure in said cavity.

11. The method of claim 6, wherein said casting machine includes a first electrode, which is insulated from said mold and exposed to said cavity at said bottom end of said cavity; a first device, which detects a first electrical resistance between the mold and said first electrode; a second electrode, which is insulated from the mold and exposed to said cavity at said top end of said cavity; and a second device, which detects a second electrical resistance between the mold and said electrode;

wherein the second timing is detected from the timing at which the second electrical resistance changes to a set value.

12. The method of claim 6, further comprising reducing the pressure difference increase to zero when a set third time period has elapsed after detecting that the melt has reached the top end of said cavity.

13. The method of claim 12, further comprising reducing the pressure difference to zero when a set fourth time period has elapsed after expiration of the predetermined third time period.

14. A method for manufacturing a cast product by controlling a differential pressure between a holding furnace and a mold cavity within a casting machine, wherein melt flows from the holding furnace through a melt duct to the mold cavity at a rate proportional to an increasing rate of said differential pressure, comprising the steps of:

setting up a differential pressure control program defining at least a first and second target increasing rates of said differential pressure, the first and second target increasing rates being assigned to a first and second predetermined time intervals, respectively;

applying said differential pressure at the first target increasing rate during the first pre-determined time interval;

detecting a time when the melt reaches a bottom level inside the mold cavity; and adjusting the increasing rate of said differential pressure to the second target increasing rate (a) when the first pre-determined time interval has expired or (b) when the melt reaches the first pre-determined level inside the mold cavity if the bottom time interval has not yet expired.

15. The method as in claim 14, wherein the increasing rate of said differential pressure is adjusted from the first target increasing rate to the second target increasing rate prior to the expiration of the first pre-determined time interval when the melt reaches the bottom level inside the mold cavity prior to the expiration of the first pre-determined time interval.

16. A method of claim 14 further comprising a step of:

adjusting the increasing rate of said differential pressure to a third target increasing rate assigned to a third pre-determined time interval (c) when the second pre-determined time interval has expired or (d) when the melt reaches a top level inside the mold cavity if the second pre-determined time interval has not yet expired.

17. The method as in claim 16, wherein the increasing rate of said differential pressure is adjusted from the second target increasing rate to the third target increasing rate prior to the expiration of the second pre-determined time interval when the melt reaches the top level inside the mold cavity prior to the expiration of the first pre-determined time interval.

18. A method for manufacturing a cast product by controlling a pressure difference between a holding furnace and a mold cavity within a casting machine, wherein melt flows from the holding furnace through a melt duct to the mold cavity at a rate proportional to an increase rate of said pressure difference, comprising the steps of:

setting up a pressure difference control program defining at least a first and second target increase rates of said pressure difference, the first and second target increase rates being assigned to a first and second pre-determined time interval, respectively;

applying the pressure difference at the first target increase rate during the first pre-determined time interval;

detecting a time when the melt reaches a bottom level inside the mold cavity; and shifting the first and second pre-determined time intervals in the pressure difference control program based on a difference between the time detected in said time detecting step and a changing time from the first pre-determined time interval to the second pre-determined time interval in the pressure difference control program.

19. The method of claim 18, further comprising a step of:

shifting the predetermined time intervals in the pressure difference control program based on a difference between a time when the melt reaches a top level inside the mold cavity and a changing time from the second pre-determined time interval to a third pre-determined time interval in the pressure difference control program.

20. The method of claim 18, wherein said detecting step comprises detecting a time when electrical resistance between the mold cavity and an electrode disposed within the mold cavity changes to a pre-determined value.

21. The method of claim 20, wherein a mechanical strength of said electrode is at least of the same level as a mechanical strength of said mold.

22. The method of claim 20, wherein the electrode is surrounded by a ceramic insulating member.

23. A method of manufacturing a cast product, comprising the steps of:

forcing melt from a holding furnace through a melt duct into a mold cavity by adjusting a pressure difference between the holding furnace and the mold cavity, the melt flowing into the mold cavity at a rate proportional to an increase rate of said pressure difference;

detecting when the melt has risen to a bottom end of the mold cavity;

reducing the increase rate of said pressure difference when the melt has reached the bottom end of the mold cavity;

detecting when the melt has risen to a top end of the mold cavity; and increasing the increase rate of said pressure difference when the melt has reached the top end of the mold cavity.

24. The method of claim 23, wherein the increase rate of said pressure difference is reduced after a first predetermined time interval has expired if the melt has not risen to the bottom end of the mold cavity before the first pre-determined time interval has expired.

25. The method of claim 23, wherein the increase rate of said pressure difference is increased after a second pre-determined time interval has expired if the melt has not risen to the top end of the mold cavity before the second pre-determined time interval has expired.

26. The method of claim 23, further comprising a step of:

setting the pressure difference to a constant value when a third pre-determined time interval has expired.

27. The method of claim 23, further comprising a step of:

setting the pressure difference to zero when a fourth pre-determined time interval has expired.

28. The method of claim 23, wherein the melt is forced from the holding furnace to the mold cavity by opening the mold cavity to the atmosphere, sealing the holding furnace and applying pressure to the holding furnace.

29. The method of claim 23, wherein the melt is forced from the holding furnace to the mold cavity by opening the holding furnace to the atmosphere, sealing the mold cavity and reducing pressure inside the mold cavity.

30. The method of claim 23, wherein the first detecting step comprises detecting when electrical resistance between, the mold cavity and a first electrode disposed at the bottom end of the mold cavity changes to a pre-determined value and the second detecting step comprises detecting when electrical resistance between the mold cavity and a second electrode disposed at the top end of the mold cavity changes to a predetermined value.

31. The method as in claim 23, wherein the second pre-determined time interval begins (i) after the increase rate of said pressure difference has been reduced, and (ii) when the melt has risen to the bottom end of the mold cavity.

32. A method of manufacturing a cast product, comprising the steps of:

generating a differential pressure between a holding furnace and a mold cavity, wherein melt flows from the holding furnace to the mold cavity via a melt duct at a rate proportional to an increasing rate of said differential pressure, wherein during a first pre-determined determined time interval (i) a first constant increasing rate of said pressure differential is applied and (ii) after the first constant increasing rate of said pressure differential is applied, a second constant increasing rate of said differential pressure different from said first constant increasing rate of said pressure differential is applied to force the melt to rise from the holding furnace to a bottom end of the mold cavity;

detecting when the melt reaches the bottom end of the mold cavity;

applying a third constant increasing rate of said differential pressure for a second pre-determined time interval that begins either (a) when the first pre-determined time interval has expired or (b) when the melt reaches the bottom end of the mold cavity if the first pre-determined time has not yet expired, the third constant increasing rate of said differential pressure being less than the first and second constant increasing rates of said differential pressure;

detecting when the melt fills the cavity; and applying a fourth constant increasing rate of said differential pressure for a third pre-determined time interval that begins either (c) when the second predetermined time interval has expired or (d) when the melt fills the cavity if the second pre-determined time has not yet expired, the fourth constant increasing rate of said differential pressure being greater than the third constant increasing rate of the said differential pressure.

33. A method according to claim 32, further comprising the step of applying a constant differential pressure for a fourth pre-determined time interval after the third pre-determined time interval has expired.

34. A method according to claim 32, further comprising the step of reducing said differential pressure to zero upon expiration of the fourth pre-determined time interval.

35. The method as in claim 32, wherein:

the third constant increasing rate of said differential pressure is applied for the second pre-determined time interval that begins (i) when the melt reaches the bottom end of the mold cavity, and (ii) before the first pre-determined time has expired; and the fourth constant increasing rate of said differential pressure is applied for the third pre-determined time interval that begins (i) when the melt fills the cavity, and (ii) before the second pre-determined time has expired.

36. A method of making a cast product using a casting apparatus comprising a furnace that stores melt; a mold cavity disposed above the furnace having a bottom surface, a top surface and a bottom portion; a melt duct connecting the furnace to the bottom portion of the mold cavity; means for applying a pressure difference between the melt stored inside the furnace and the pressure inside the mold cavity; target value storing means for storing a set of target values for controlling pressure differences between the furnace and the mold cavity; a first melt sensor disposed on the bottom surface of the mold cavity; a second melt sensor disposed on the top surface of the mold cavity; and a timer for determining:

(a) a first amount of time from initiating an increase in the pressure difference to force melt from the furnace until detection of the melt by the first melt sensor, and (b) a second amount of time from detection of the melt by the first melt sensor until detection of the melt by the second melt sensor, the method comprising the steps of:

storing an initial set of target values in the target value storing means, the initial set of target values representing: (1) a first rate of pressure increase, (2) a second rate of pressure increase, (3) a third rate of pressure increase, (4) a first time period for applying the first rate of pressure increase, and (5) a second time period for applying the second rate of pressure increase, wherein the first rate of pressure increase is greater than the second rate of pressure increase, and the second rate of pressure increase is less than the third rate of pressure increase;

applying the first rate of pressure increase to the melt to force the melt up the melt duct and into the mold cavity and simultaneously beginning the first time period for applying the first rate of pressure increase;

using the first melt sensor to detect when the melt has reached the first melt sensor;

using the timer to determine the first amount of time from initiating the first rate of pressure increase to force melt from the furnace until detection of the melt by the first melt sensor;

applying the second rate of pressure increase to the melt at the earlier of (1) expiration of the first time period for applying the first rate of pressure increase, or (2) detection of the melt by the first melt sensor, and simultaneously beginning the second time period for applying the second rate of pressure increase when the second rate of pressure increase is applied to the melt;

wherein, if the first melt sensor detects the melt before the first time period for applying the first rate of pressure increase has expired, replacing the first time period for applying the first rate of pressure increase stored in the target value storing means with the first amount of time from initiating the first rate of pressure increase until detection of the melt by the first melt sensor, and wherein, if the first melt sensor detects the melt after the first time period for applying the first rate of pressure increase has expired, restarting the second time period for applying the second rate of pressure increase when the melt is detected and replacing the first time period for applying the first rate of pressure increase stored in the target value storing means with the first amount of time from initiating the first rate of pressure increase until detection of the melt by the first melt sensor;

using the second melt sensor to detect when the melt reaches the second melt sensor;

using the timer to determine the second amount of time between the detection of the melt by the first melt sensor and the detection of the melt by the second melt sensor; and applying the third rate of pressure increase to the melt at the earlier of (1) expiration of the second time period for applying the second rate of pressure increase or (2) detection of the melt by the second melt sensor;

wherein, if the second melt sensor detects the melt before or after the second time period for applying the second rate of pressure increase has expired, replacing the second time period for applying the second rate of pressure increase stored in the target value storing means with the second amount of time between the detection of the melt by the first melt sensor and the detection of the melt by the second melt sensor.

37. The method as in claim 36, comprising:

detecting the melt with the first melt sensor before the first time period for applying the first rate of pressure increase has expired; and replacing the first time period for applying the first rate of pressure increase stored in the target value storing means with the first amount of time from initiating the first rate of pressure increase until detection of the melt by the first melt sensor, wherein the first time period is replaced before the mold cavity is filled with the melt.

38. The method as in claim 36, comprising:

detecting the melt with the first melt sensor after the first time period for applying the first rate of pressure increase has expired;

restarting the second time period for applying the second rate of pressure increase when the melt is detected; and replacing the first time period for applying the first rate of pressure increase stored in the target value storing means with the first amount of time from initiating the first rate of pressure increase until detection of the melt by the first melt sensor, wherein the first time period is replaced before the mold cavity is filled with the melt.

39. The method as in claim 36, wherein the third rate of pressure increase is applied for a third time period, and the method further comprises applying a constant rate of pressure after the third time period expires.

40. The method as in claim 39, wherein a constant pressure is applied for a fourth time period and the pressure is reduced to zero when the fourth time period expires.

41. The method as in claim 40, wherein the first and second melt sensors detect the melt reaching the respective first and second melt sensors as a change in electrical resistance of the respective first and second melt sensors.

42. The method as in claim 41, wherein the first and second melt sensors are each surrounded by a ceramic insulating member.

43. The method as in claim 40, wherein the first and second melt sensors detect the melt reaching the respective first and second melt sensors as a change in current flow through the respective first and second melt sensors.

44. The method as in claim 43, wherein the first and second melt sensors are each surrounded by a ceramic insulating member.

45. A method of making a cast product using a casting apparatus comprising a furnace that stores melt; a mold cavity disposed above the furnace having a bottom surface, a top surface and a bottom portion; a melt duct connecting the furnace to the bottom portion of the mold cavity; means for applying a pressure difference between the melt stored inside the furnace and the pressure inside the mold cavity; means for storing a set of target values for controlling the pressure difference between the furnace and the mold cavity; a first melt sensor disposed on the bottom surface of the mold cavity; a second melt sensor disposed on the top surface of the mold cavity; and a timer for determining:

(a) a first amount of time from initiating an increase in the pressure difference to force melt from the furnace until a first time period expires, (b) a second amount of time from expiration of the first time period until detection of the melt by the first melt sensor, and (c) a third amount of time from detection of the melt by the first melt sensor until detection of the melt by the second melt sensor, the method comprising the steps of:

storing an initial set of target values in the target value storing means, the initial set of target values representing (1) a first rate of pressure increase, (2) a second rate of pressure increase, (3) a third rate of pressure increase, (4) a fourth rate of pressure increase, (5) a first time period for applying the first rate of pressure increase, (6) a second time period for applying the second rate of pressure increase, (7) a third time period for applying the third rate of pressure increase, and (8) a fourth time period for applying the fourth rate of pressure increase, wherein the first rate of pressure increase is greater than the second rate of pressure increase, the second rate of pressure increase is greater than the third rate of pressure increase and the third rate of pressure increase is less than the fourth rate of pressure increase;

applying the first rate of pressure increase to the melt to force the melt up the melt duct and into the mold cavity and simultaneously beginning the first time period for applying the first rate of pressure increase;

applying the second rate of pressure increase after the first time period for applying the first rate of pressure increase has expired and simultaneously beginning the second time period for applying the second rate of pressure increase;

using the first melt sensor to detect when the melt reaches the first melt sensor;

using the timer to determine a first actual amount of time between initiating the second rate of pressure increase and detection of the melt by the first melt sensor;

applying the third rate of pressure increase to the melt at the earlier of (1) expiration of the second time period for applying the second rate of pressure increase, or (2) detection of the melt at the first melt sensor, and simultaneously beginning the third time period for applying the third rate of pressure increase;

wherein, if the first melt sensor detects the melt before the second time period for applying the second rate of pressure increase has expired, replacing the second time period for applying the second rate of pressure increase stored in the target value storing means with the first actual amount of time between initiating the second rate of pressure increase and detection of the melt by the first melt sensor, and wherein, if the first melt sensor detects the melt after the second time period for applying the second rate of pressure increase has expired, restarting the third time period for applying the third rate of pressure increase when the melt is detected and replacing the second time period for applying the second rate of pressure increase stored in the target value storing means with the first actual amount of time between initiating the second rate of pressure increase and detection of the melt by the first melt sensor, using the second melt sensor to detect when the melt reaches the second melt sensor;

using the timer to determine a second actual amount of time between the detection of the melt by the first melt sensor and the detection of the melt by the second melt sensor, and applying the fourth rate of pressure increase to the melt at the earlier of (1) expiration of the third time period for applying the third rate of pressure increase, or (2) detection of the melt by the second melt sensor;

wherein, if the second melt sensor detects the melt before or after the third time period for applying the third rate of pressure increase has expired, replacing the third time period for applying the third rate of pressure increase stored in the target value storing means with the second actual amount of time between the detection of the melt by the first melt sensor and the detection of the melt by the second melt sensor.

46. The method as in claim 45, comprising:

detecting the melt with the first melt sensor before the second time period for applying the second rate of pressure increase has expired;

replacing the second time period for applying the second rate of pressure increase stored in the target value storing means with the first actual amount of time between initiating the second rate of pressure increase and detection of the melt by the first melt sensor, wherein the second time period is replaced before the mold cavity is filled with the melt.

47. The method as in claim 45, comprising:

detecting the melt with the first melt sensor after the second time period for applying the second rate of pressure increase has expired;

restarting the third time period for applying the third rate of pressure increase when the melt is detected;

replacing the second time period for applying the second rate of pressure increase stored in the target value storing means with the first actual amount of time between initiating the second rate of pressure increase and detection of the melt by the first melt sensor, wherein the second time period is replaced before the mold cavity is filled with the melt.

48. The method as in claim 45, comprising:

detecting the melt with the second melt sensor before or after the third time period for applying the third rate of pressure increase has expired; and replacing the third time period for applying the third rate of pressure increase stored in the target value storing means with the second actual amount of time between the detection of the melt by the first melt sensor and the detection of the melt by the second melt sensor.

49. The method as in claim 45, wherein the fourth rate of pressure increase is applied for a fourth time period, and the method further comprises applying a constant pressure after the fourth time period expires.

50. The method as in claim 49, wherein the constant pressure is applied for a fifth time period and the pressure is reduced to zero when the fifth time period expires.

51. The method as in claim 50, wherein the first and second melt sensors detect the melt reaching the respective first and second melt sensors as a change in electrical resistance of the respective first and second melt sensors.

52. The method as in claim 51, wherein the first and second melt sensors are each surrounded by a ceramic insulating member.

53. The method as in claim 50, wherein the first and second melt sensors detect the melt reaching the respective first and second melt sensors as a change in current flow through the respective first and second melt sensors.

54. The method as in claim 53, wherein the first and second melt sensors are each surrounded by a ceramic insulating member.

* * * * *